United States Patent [19]

Brandt

[11] Patent Number: 4,767,269

[45] Date of Patent: Aug. 30, 1988

[54] ROTOR SYSTEM, PARTICULARLY A BOAT PROPELLER SYSTEM

[75] Inventor: Lennart H. Brandt, Fjäras, Sweden

[73] Assignee: AB Volvo Penta, Gothenburg, Sweden

[21] Appl. No.: 802,217

[22] Filed: Nov. 26, 1985

[30] Foreign Application Priority Data

Nov. 29, 1984 [SE] Sweden ..... 8406040

[51] Int. Cl.[4] ..... B63H 5/10

[52] U.S. Cl. ..... 416/124; 416/129; 416/171; 415/62; 415/143

[58] Field of Search ..... 416/124, 171, 128, 175, 416/129 A, 129 R, 193 R; 415/62, 143, 66, 68, 67, 91

[56] References Cited

U.S. PATENT DOCUMENTS

| | | | |
|---|---|---|---|
| 2,321,276 | 6/1943 | DeBolt | 415/143 X |
| 2,397,998 | 4/1946 | Goddard | 416/171 X |
| 2,426,635 | 9/1947 | Mercier | 416/124 X |
| 2,505,660 | 4/1950 | Baumann | 416/129 X |
| 3,092,184 | 6/1963 | Day | 416/175 R X |
| 3,261,544 | 7/1966 | Guichard | 416/171 |
| 3,391,540 | 7/1968 | Bauger et al. | 415/62 X |
| 3,405,526 | 10/1968 | Aschauer | 415/62 X |
| 3,549,271 | 12/1970 | Kubota | 416/124 |
| 3,574,477 | 4/1971 | Dolf | 415/60 |
| 4,604,032 | 8/1986 | Brandt et al. | 416/128 |
| 4,623,299 | 11/1986 | Grim | 416/124 |

FOREIGN PATENT DOCUMENTS

| | | | |
|---|---|---|---|
| 23468 | 5/1930 | Australia | 416/175 R |
| 263738 | 9/1912 | Fed. Rep. of Germany . | |
| 1032605 | 6/1958 | Fed. Rep. of Germany . | |
| 1084981 | 7/1960 | Fed. Rep. of Germany . | |
| 1556851 | 1/1970 | Fed. Rep. of Germany | 416/124 |
| 1756889 | 1/1970 | Fed. Rep. of Germany | 416/124 |
| 894822 | 1/1945 | France | 416/193 R |
| 175922 | 3/1922 | United Kingdom | 416/128 |
| 1132117 | 10/1968 | United Kingdom . | |
| 2129502 | 5/1984 | United Kingdom | 416/171 |

*Primary Examiner*—Everette A. Powell, Jr.
*Attorney, Agent, or Firm*—Young & Thompson

[57] ABSTRACT

The invention relates to a rotor system, particularly a boat propeller system, which consists of a main propeller and a turbo unit in the form of a fore-propeller and a turbine mechanically coupled thereto, the turbo unit being freely rotatably journalled.

6 Claims, 1 Drawing Sheet

ROTOR SYSTEM, PARTICULARLY A BOAT PROPELLER SYSTEM

The present invention relates to a rotor system, particularly a boat propeller system, comprising a first rotor unit adapted to impart energy to a surrounding medium or absorb energy from a flowing surrounding medium.

For propulsion of boats a propeller is normally used which is mounted on a rotary shaft. The propeller blades are pitched and cupped, but have relatively planar surfaces at an inclined angle relative to the plane of rotation, corresponding to the propeller pitch. In principle, the propeller functions as follows: water is driven backwards producing a reactive force forwards corresponding to the thrust. As it moves through the water the propeller leaves a rotating cylinder of water which moves backwards. The kinetic energy in the water cylinder constitutes the major portion of the propeller energy loss, which for a propeller for boats can be 30–35% axial kinetic energy, 6–7% rotational energy and 9–11% blade friction, eddies etc, amounting to about 50% lost energy and about 50% utilized energy.

Of the losses listed above, blade friction can not be changed appreciably. The blade surface is determined by the maximum pressure difference over the blades without cavitation. The rotational energy can, however, be affected by imparting an opposite prerotation through the water (by means of fixed vanes or a freely rotating fore-propeller) or by rectifying the flow from the propeller system. Another possibility is arranging a pair of counter-rotating driven propellers, the after-propeller using the rotational energy from the fore-propeller.

The purpose of the present invention is to achieve a rotor system by means of which it is possible to affect the major source of energy loss, namely the axial kinetic energy in the water cylinder.

This is achieved according to the invention in a rotor system of the type described in the introduction by arranging a second rotor unit which has a common rotational axis with the first unit and has at least two freely rotatably journalled rotors, which are mechanically joined to each other and are disposed on either side of the first rotor unit.

The rear rotor of the second rotor unit functions in this case as a turbine and absorbs approximately a third of the axial energy, thus driving the forward rotor, which increases the average velocity and thus the flow through the first rotor unit. Increased flow and lower exit velocity of the water after the propeller increases the efficiency. When the rotor system is used as a propeller system for boats, the axial kinetic energy loss can be reduced by about 20–25%, thus increasing the efficiency by approximately 5–7%. The torque absorption of the propeller is also evened out, thus increasing thrust when towing by allowing the drive unit of the main propeller to function at a higher rotational speed.

Figure 1:
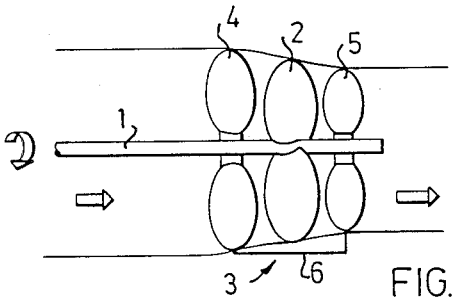
Figure 2:
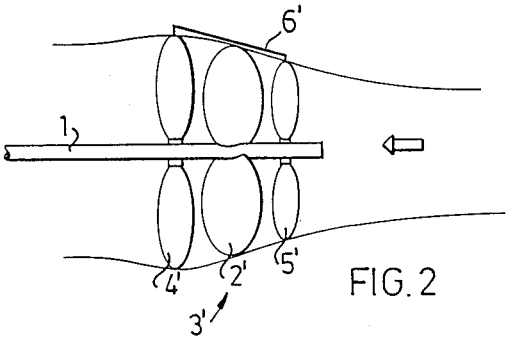

The accompanying drawing shows in FIG. 1 schematically a boat propeller system according to the invention, and in FIG. 2 a turbine system.

In FIG. 1, 1 designates a propeller shaft driven by a drive unit (not shown) to which shaft a main propeller 2 is solidly mounted. A propeller unit, generally designated 3, is freely rotatably journalled on the shaft 1. The unit 3 consists of two rotors 4 and 5, respectively, mounted on either side of the main propeller 2, and which are mechanically rigidly joined to each other by means of vanes 6 at the blade tips.

The after-rotor 5 is a turbine, which drives the forward propeller 4. The combination thus forms a turbo-unit, which charges the active propeller 2 with the flow which will also be dependent on the propeller load.

At full load, i.e. at approximately constant torque, the flow through the propeller 2 will increase with boat speed, which also means that the induced velocities will drop with increasing speed.

The turbo-unit 3 can rotate in the same direction or in the opposite direction as the main propeller 2, thereby imparting different properties to the system. The turbine assumes the rotational speed which provides an angle of flow against the blades of a few degrees. With a turbo-unit 3 rotating in the same direction as the main propeller, the rotational speed of the unit increases about 20% if the rotational speed of the propeller 2 is doubled at full load, switching from low boat speed (towing) to high speed. In a counter-rotating turbo-unit 3 with the corresponding increase in the rpm of the propeller 2, the rpm of the turbo-unit will more than double and the flow through the propeller 2 will increase. This evens out to a certain extent the torque absorption of the propeller for different loads.

The turbo-unit 3 will supply the propeller 2 with an increased flow, which means that for a given engine power, the diameter of the propeller 2 must be reduced.

The effect of the turbo-unit as compared with a single propeller is thus increased flow with reduced load, which provides an evening out of the torque absorption and thus makes possible greater thrust at low speeds (towing) because the engine can be driven faster and thus deliver greater power to the propeller system. Furthermore, a relatively greater flow and lower exit velocity increases efficiency.

FIG. 2 shows the rotor system reversed with a main turbine 2' on a shaft 1' and a rotor unit 3' consisting of a fore-turbine 5' and a propeller 4'. As before, the fore-turbine 5' and the propeller 4' are mechanically rigidly joined to each other by means of vanes 6' at the blade tips and the rotor unit 3' thus formed is freely rotatably journalled on the shaft 1'. The flow through the system is increased by increasing the average axial velocity through the first turbines 5,2, the flow being "sucked out" via the propeller 4.

I claim:

1. An axial flow rotor device, comprising a first boat propeller unit non-rotatably joined to a propeller shaft and an idle axial flow second propeller unit having at least two propellers which are freely rotatably journalled on the propeller shaft and are disposed on either axial side of the first propeller unit, each propeller having a plurality of blades terminating outwardly in blade tips, and rigid connecting members extending across said first propeller unit and rigidly interconnecting the blade tips on one of said at least two propellers with the blade tips on another of said at least two propellers thereby to join said at least two propellers to each other for rotation at the same angular velocity as each other.

2. Rotor device according to claim 1, wherein the pitches of the propeller units are such that the propeller units rotate in opposite directions.

3. Rotor device according to claim 1, wherein the pitches of the propeller units are such that the propeller units rotate in the same direction.

4. An axial flow rotor device comprising a first turbine rotor unit non-rotatably joined to a turbine shaft and an idle axial flow second turbine rotor unit having at least two rotors which are freely rotatably journalled on the turbine shaft and are disposed on either side of the first turbine rotor unit, each rotor having a plurality of blades terminating outwardly in blade tips, and rigid connecting members extending across said first turbine rotor unit and rigidly interconnecting the blade tips on one of said at least two rotors with the blade tips on another of said at least two rotors thereby to join said at least two rotors to each other for rotation at the same angular velocity as each other.

5. Rotor device according to claim 4, wherein the pitches of the rotor units are such that the rotor units rotate in opposite directions.

6. Rotor device according to claim 4, wherein the pitches of the rotor units are such that the rotor units rotate in the same direction.

* * * * *